US011085268B2

(12) United States Patent
Radtke et al.

(10) Patent No.: US 11,085,268 B2
(45) Date of Patent: Aug. 10, 2021

(54) ISOLATION BARRIER ASSEMBLY

(71) Applicant: MorphPackers Limited, Westhill (GB)

(72) Inventors: Cameron Hill Radtke, Westhill (GB); Christopher Brian Kevin Cockrill, Westhill (GB); Philip Henry Turrell, Westhill (GB)

(73) Assignee: MORPHPACKERS LIMITED

( * ) Notice: Subject to any disclaimer, the term of this patent is extended or adjusted under 35 U.S.C. 154(b) by 50 days.

(21) Appl. No.: 16/571,251

(22) Filed: Sep. 16, 2019

(65) Prior Publication Data

US 2020/0088007 A1 Mar. 19, 2020

(30) Foreign Application Priority Data

Sep. 18, 2018 (GB) ..... 1815590

(51) Int. Cl.
*E21B 33/127* (2006.01)

(52) U.S. Cl.
CPC ..... *E21B 33/127* (2013.01)

(58) Field of Classification Search
CPC .... E21B 33/12; E21B 33/127; E21B 33/1277; E21B 33/1208; E21B 33/1243
See application file for complete search history.

(56) References Cited

U.S. PATENT DOCUMENTS

RE41,118 E * 2/2010 Brezinski ..... E21B 33/12 166/387
2013/0186615 A1* 7/2013 Hallunbæk ..... E21B 23/06 166/120
2016/0115761 A1* 4/2016 Martin ..... E21B 33/1277 166/387

FOREIGN PATENT DOCUMENTS

WO WO 2012/045813 A1 4/2012
WO WO 2016/063048 A1 4/2016

OTHER PUBLICATIONS

Intellectual Property Office (United Kingdom); Search Report for GB1815590.3; dated Feb. 28, 2019; all pages; Intellectual Property Office, United Kingdom.

* cited by examiner

*Primary Examiner* — David Carroll
(74) *Attorney, Agent, or Firm* — Law Office of Jesse D. Lambert, LLC

(57) ABSTRACT

A method of manufacturing an assembly for use as an isolation barrier to be run in and secured within a well. The assembly has a first tubular section providing a mandrel portion over which a sleeve body is located. The sleeve body is initially welded to a second tubular section to provide a part assembly which can be welded, inspected and machined without affecting the mandrel portion. The second tubular section is then coupled to the first tubular section and the sleeve body welded to the first tubular section to provide a chamber between the sections and the sleeve body. In use, fluid can enter the chamber through a port in the mandrel portion and morph the sleeve against a larger diameter surface in the well. In an embodiment the second tubular section includes a support for the sleeve body during initial welding which is then machined away.

13 Claims, 5 Drawing Sheets

Detail A

ISOLATION BARRIER ASSEMBLY

The present invention relates to a method of manufacturing an assembly for use as an apparatus for securing a tubular within another tubular or borehole, creating a seal across an annulus in a well bore, centralising or anchoring tubing within a wellbore. In particular, though not exclusively, the invention relates to a method of manufacturing an assembly in which a sleeve is morphed to secure it to a well bore wall and create a seal between the sleeve and well bore wall.

In the exploration and production of oil and gas wells, packers are typically used to isolate one section of a downhole annulus from another section of the downhole annulus. The annulus may be between tubular members, such as a liner, mandrel, production tubing and casing or between a tubular member, typically casing, and the wall of an open borehole. These packers are carried into the well on tubing and at the desired location, elastomeric seals are urged radially outwards or elastomeric bladders are inflated to cross the annulus and create a seal with the outer generally cylindrical structure i.e. another tubular member or the borehole wall. These elastomers have disadvantages, particularly when chemical injection techniques are used.

As a result, metal seals have been developed, where a tubular metal member is run in the well and at the desired location, an expander tool is run through the member. The expander tool typically has a forward cone with a body whose diameter is sized to the generally cylindrical structure so that the metal member is expanded to contact and seal against the cylindrical structure. These so-called expanded sleeves have an internal surface which, when expanded, is cylindrical and matches the profile of the expander tool. These sleeves work create seals between tubular members but can have problems in sealing against the irregular surface of an open borehole. The present applicants have developed a technology where a metal sleeve is forced radially outwardly by the use of fluid pressure acting directly on the sleeve. Sufficient hydraulic fluid pressure is applied to move the sleeve radially outwards and cause the sleeve to morph itself onto the generally cylindrical structure. The sleeve undergoes plastic deformation and, if morphed to a generally cylindrical metal structure, the metal structure will undergo elastic deformation to expand by a small percentage as contact is made. When the pressure is released the metal structure returns to its original dimensions and will create a seal against the plastically deformed sleeve. During the morphing process, both the inner so and outer surfaces of the sleeve will take up the shape of the surface of the wall of the cylindrical structure. This morphed isolation barrier is therefore ideally suited for creating a seal against an irregular borehole wall.

Such a morphed isolation barrier is disclosed in U.S. Pat. No. 7,306,033, which is incorporated herein by reference. An application of the morphed isolation barrier for FRAC operations is disclosed in US2012/0125619, which is incorporated herein by reference.

Such isolation barriers are formed of a metal sleeve mounted around a supporting tubular body, and sealed at each end of the sleeve to create a chamber between the inner surface of the sleeve and the outer surface of the body. A port is arranged through the body so that fluid can be pumped into the chamber from the throughbore of the body. The increase in fluid pressure within the chamber causes radial expansion of the sleeve so that it is morphed onto the wall of the outer larger diameter structure which may be, for example, casing or open borehole.

To mount the sleeve upon the supporting tubular body requires a complicated arrangement of fittings to provide fixing and sealing of two cylindrical surfaces to each other. An arrangement is disclosed in US2012/0125619 in which an end nut is secured to the tubular body by suitable means. There is then provided a seal section housing which is screwed fast to the end nut and which surrounds a suitable arrangement of seals. The inner most ends of the respective seal section housings are secured to the respective ends of the sleeve by welding. A weld shroud is then provided co-axially about the outer surface of the weld, the respective end of the sleeve and the inner most end of the sealed section housing. The weld shroud is secured to the inner most end of the sealed section housing via a suitable screw threaded connection by welding. However, this arrangement is expensive and takes considerable time to assemble.

An alternative arrangement is disclosed in WO2016/063048 and is shown in FIG. 1, wherein the arrangement comprises a tubular body T having first and second tubular sections A, B with tubular section A providing a central mandrel C. The tubular body T is further provided with sleeve member D formed of a different material from the tubular sections A,B. The metal sleeve member material is more ductile and thus more easily expandable than the material of the tubular sections A,B. The tubular sections A,B are coupled together via a weld or screwthread. The sleeve D is positioned on the exterior of the body T around the central mandrel C and is secured to the first and second tubular sections A,B by a weld to provide connections E1,E2 such that a chamber F is formed between the central mandrel C and sleeve D. Port G is formed through the tubular body T and enables fluid pressure to be applied to the chamber F. The fluid pressure can either be applied through application of an increase of pressure within the tubular applied from surface; or, fluid pressure can be applied from within the tubular by use of a hydraulic pressure delivery tool. The fluid pressure applied to the chamber causes the sleeve D to expand and move radially outward so that it is morphed onto the wall of a surrounding outer larger diameter structure which may be casing or borehole.

However, creating this sleeve assembly is a complicated process and, given the precision of the joints required, it is preferred to use electron beam welding to secure the sleeve to the tubular sections. By welding the sleeve in position once it is mounted upon the mandrel, the weld can cause damage to the mandrel by penetrating and weakening it. This is illustrated in FIG. 2 which shows a close up of an electron beam weld E2 between sleeve D and tubular section B mounted on mandrel C. As can be seen, a first end of the weld E' extends into the body of mandrel C with approximately 50% of the thickness of the mandrel C weakened by the weld penetration E'. Even were the weld may not penetrate the mandrel, a region around the weld called the HAZ, or heat affected zone, will affect the in properties of the mandrel. A HAZ will be created at electron beam weld E1, but is better dissipated around the thicker tubular section A.

Furthermore, once the assembly is welded together it becomes difficult to assess the quality of the joints without other parts of the assembly interfering in the x-ray or other assessment process. In addition, as the parts are all machined separately then assembled together, the machine tolerances must be set to a very high level of accuracy as a perfect fit together is essential making this a costly process.

It is therefore an object of at least one embodiment of the present invention to provide method of manufacturing an assembly for use as an isolation barrier which obviates or mitigates one or more disadvantages of the prior art.

According to an aspect of the present invention there is provided a method of manufacturing an assembly for use as an isolation barrier, which when assembled comprises:

a first tubular section, the first tubular section including: at a first end a coupling to connect the first tubular section to a tubular string; a mandrel portion extending to a second end; and an annular face formed on a ledge arranged circumferentially around and extending radially outwards from an outer surface of the first tubular section;

a second tubular section, the second tubular section including: at a first end a coupling to connect the second tubular section to a tubular string; and at a second end, an annular face arranged perpendicularly to a central axis of the second tubular section;

a sleeve body, being a tubular section having first and second end faces, respectively, at each end thereof;

wherein: the sleeve body is arranged over the mandrel portion between the first and second tubular sections; the annular face of the first tubular section is welded to the first end face of the sleeve body; the annular face of the second tubular portion is welded to the second end face of the tubular body; and the mandrel portion is connected to the second tubular portion so as to create a chamber between the sleeve body and the mandrel portion, which can be filled with fluid via a port in the mandrel portion so as to expand the sleeve body;

the method comprising the steps, in order:

(a) welding the annular face of the second tubular section to the second end face of the sleeve body;

(b) machining the sleeve body and the second tubular portion to provide a central bore of a first diameter over the weld;

(c) sliding the sleeve body over the mandrel portion;

(d) coupling the mandrel portion to the second tubular section; and (e) welding the annular face of the first tubular section to the first end face of the sleeve body.

By welding the sleeve body to the second tubular portion before connecting to the mandrel portion, the mandrel is not affected by the welding process as occurs in the prior art assembly method. The weld can be fully inspected prior being placed on the mandrel so that the reliability of the weld will be better than for the prior art. Machining of the welded sections can also be done before the pieces are fully assembled.

Preferably, the annular face arranged perpendicularly to the central axis of the second tubular section is provided on a ledge so that the sleeve body is supported at the second end face for the welding at step (a) to be carried out. In this way the weld pieces support each other during the weld and the faces will be automatically aligned.

Preferably, the weld at step (a) is a gas metal arc weld (GMAW). In this way a strong weld can be formed without concern over the large HAZ area produced. Though this could also be an electron beam weld, GMAW or other conventional welding is preferred because its generally cheaper/more available.

More preferably, at step (b) machining removes a portion of the second tubular section so that only the ledge remains and the welded joint provides connection of two abutting annular faces. In this way, the sleeve body and a portion of the second tubular section can be located over the mandrel portion. In this way, the assembly will match the prior art arrangement when assembled.

Preferably, the weld at step (a) is formed by a different technique than the weld at step (e). In this way, the weld can be tailored to a piece available for full inspection as against a weld made on a final assembly. Preferably, the weld at step (e) is an electron beam weld (e-beam). In this way, this weld has a smaller HAZ than the GMAW weld, so affecting less of the assembly.

The coupling between the mandrel portion and the second tubular section may be by screw-threads. In this way, the assembly does not require any rubber seals such as o-rings to seal the chamber. Alternatively, the coupling may be by welding.

The method may include a further step of machining over the weld of step (e). In this way, a uniform outer diameter to the assembly can be provided.

The method may include the step of selecting a sleeve body having a material which yields more easily under pressure than the material of the first and second tubular sections. In this way, the sleeve body will expand under fluid pressure, in use, to create the barrier.

The method may include the step of machining the outer surface of the sleeve body over a portion thereof, to reduce the thickness of the sleeve body. In this way, the sleeve body has a thin wall for ease of expansion while providing thicker ends for welding to the tubular sections.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 3A:
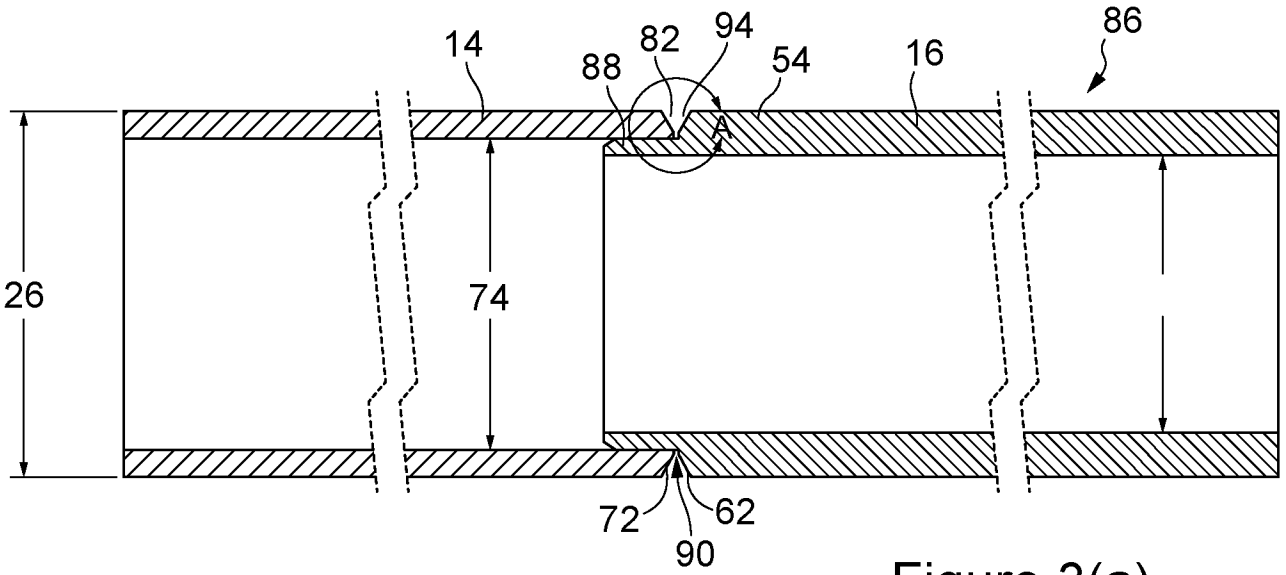
FIG. 3(*a*) is a cross-sectional view through a sleeve body and second tubular section of an assembly at step (a) according to an embodiment of the present invention and FIG. 3(*b*) is an expanded view of the weld location.
Figure 3B:
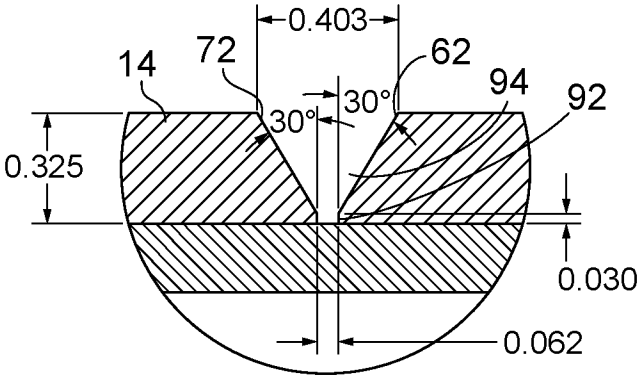
Figure 5A:
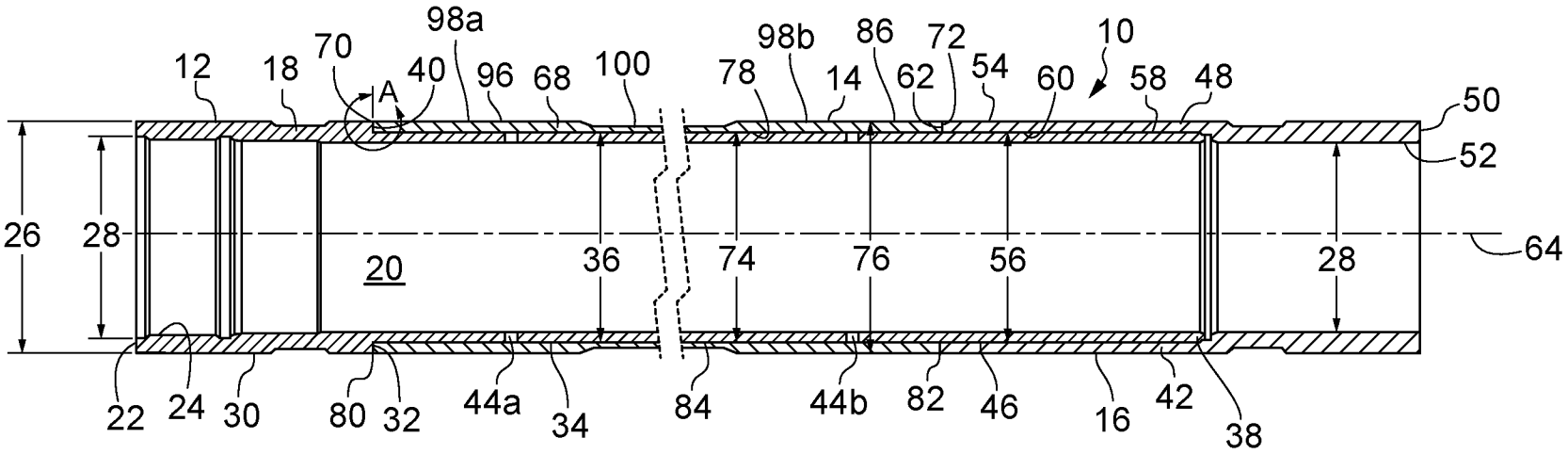
Figure 5B:
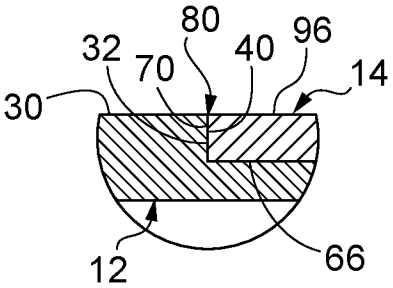
Figures 6A, 6B:
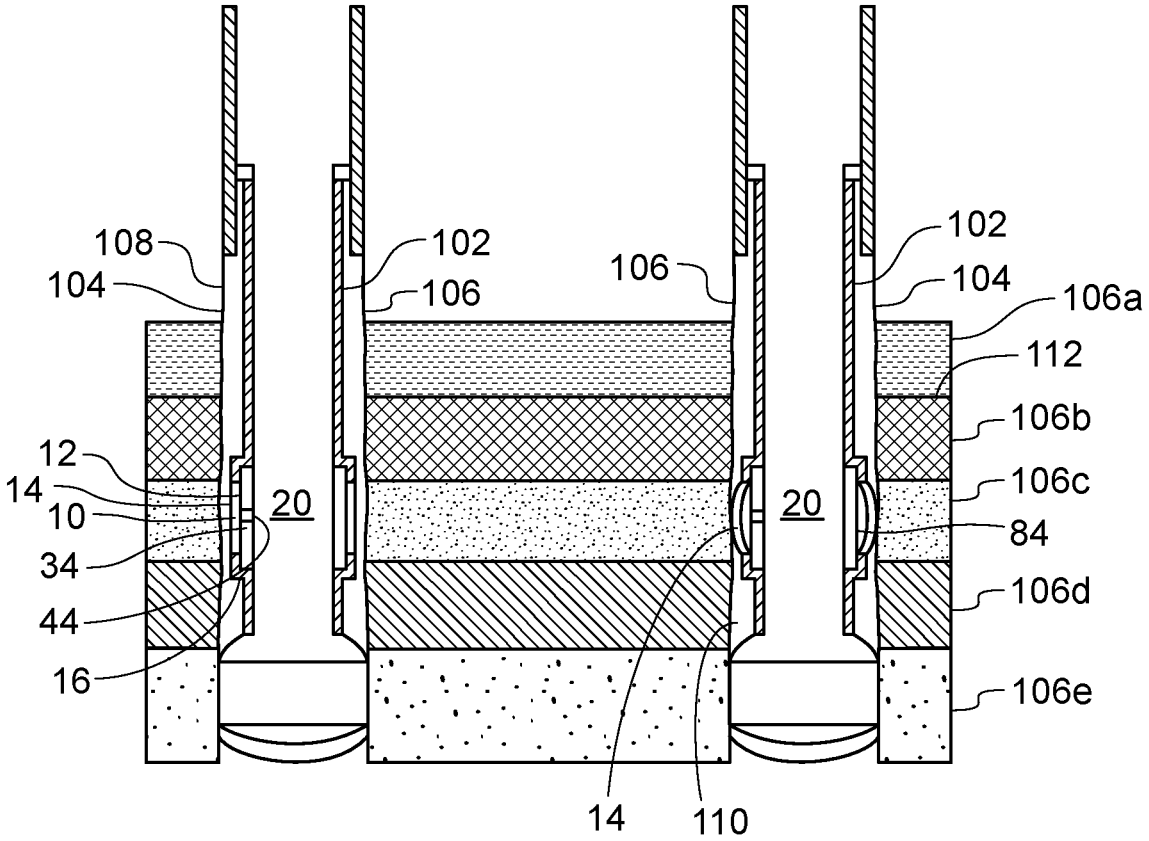

FIG. 5(*a*) is a part cross-sectional view through the assembly of FIG. 3(*a*) illustrating steps (c) to (e), with FIG. 5(*b*) being an expanded view to illustrate step (e), according to an embodiment of the present invention; and FIGS. 6(*a*) and 6(*b*) are a schematic illustration of a sequence for setting the assembly in an open borehole of which: FIG. 6(*a*) is a cross-sectional view of a tubular string provided with an assembly according to the present invention and FIG. 6(*b*) is a cross-sectional view of the tubular string of FIG. 6(*a*) with a morphed sleeve, in use.

Reference is initially made to FIG. 5(*a*) of the drawings which illustrates an assembly, generally indicated by reference numeral 10, for use as an isolation barrier manufactured according to an embodiment of the present invention.

Assembly 10 comprises three pieces, a first tubular section 12, a sleeve body 14 and a second tubular section 16. First tubular section 12 has a cylindrical body 18 proving a central bore 20. At a first end 22 it has a coupling 24, which may be a box section as is known in art, for connecting the first end 22 into a tubing string (not shown). The first tubular section 12 has a maximum outer diameter 26 and a minimum inner diameter 28. The outer diameter 26 is selected to fit within casing or a borehole in which the assembly is intended to be set against to form an isolation barrier. The inner diameter 28 is selected to provide the maximum available through bore capacity for the potential passage of another string through the bore 20. The outer surface 30 of the first tubular section 12 is machined to provide a ledge 32 or rim and a mandrel portion 34 with an outer diameter 36 less than the maximum outer diameter 26. Ledge 32 provides a planar annular face 40 facing a second end 38 of the first tubular section 12. At the second end 38, a screw thread 42 is provided on the outer surface 46 of the mandrel portion 34. The mandrel portion 34 has ports 44*a,b* extending therethrough to provide a fluid passageway from the central bore 20 to the outer surface 46 of the mandrel portion 34.

Second tubular section 16 also has a cylindrical body 48, with an outer and inner diameter 26,28 matching those of the first tubular section 12. At a first end 50 of the second tubular section 16, there is also provided a coupling 52, which may be a pin section as is known in the art, for connecting the first end 50 to a tubular string (not shown) so that the assembly can be run-in on the tubular string. Towards a second end 54, opposite the first end 50, the cylindrical body has an increased inner diameter 56 to match the outer diameter 36 of the mandrel portion 34 of the first tubular section 12. The increased inner diameter 56 terminates with a screw-thread 58 on the inner surface 60. The second end 54 provides an annular face 62 which is substantially perpendicular to the central longitudinal axis 64 of the central bore 20. The first and second tubular sections 12,16 are coupled together via mating of the screw-threads 42,58.

The sleeve body 14 is also a cylindrical body 68 having first 70 and second 72 annular end faces, respectively. The sleeve body 14 has an inner diameter 74 which matches the outer diameter 36 of the mandrel portion 34 so that it can be slid over the mandrel portion 34 and be supported thereon. The outer diameter 76 of the sleeve body 14, at the end faces 70,72 matches the outer diameter 26 of the first 12 and second 16 tubular sections. The first end face 70 is welded to the annular face 40 at weld 80. The second end face 72 is welded to the annular face 62 at weld 82. The inner surface 78 of the sleeve body 14, the outer surface 46 of the mandrel portion 34 and the two weld locations 80,82 provide a chamber 84 which can be accessed via the ports 44*a,b* from the central bore 20.

Figure 1:
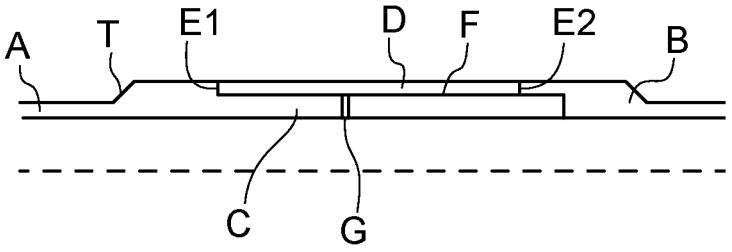
Figure 1 PRIOR ART
FIG. 1 is a part cross-sectional view through an isolation barrier according to the prior art.
Figure 2:
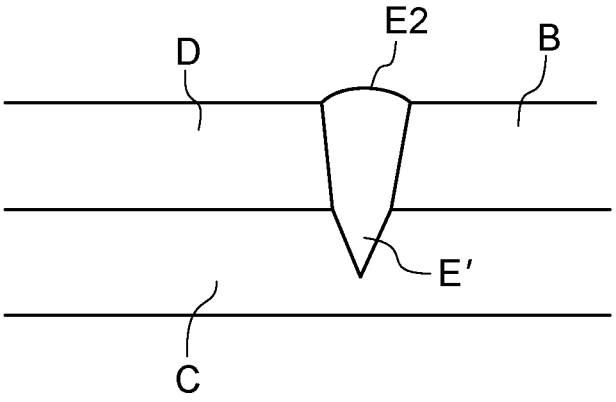
Figure 2 PRIOR ART
FIG. 2 is a part cross-sectional view through a detail of an assembly according to the prior art.

The similarity between the assembly 10 shown in FIG. 5(*a*) and that of the prior art shown in FIG. 1 is noted. The present invention is to the manufacture of the assembly 10. In the prior art, the first tubular section 12 and the second tubular section 16 are coupled together with the sleeve body sandwiched therebetween. Welding is then undertaken at the locations 80,82. As a result, the mandrel portion 34 at the location 82 can be subject to weld penetration, as shown in FIG. 2, and/or be affected by heat from the HAZ zone. It is also difficult to test the integrity of the weld due to the assembly 10 being constructed and by the presence of the mandrel portion 34.

In the present invention, the sleeve body 14 is first welded to the second tubular section 16. This part assembly 86 is then joined to first tubular section 12. By forming the assembly 10 in this way, any type of weld can be selected for the weld 82 in the part assembly 86 as this has the opportunity to be inspected at both sides of the weld 82. The part assembly can also be finished in that the inner and outer surfaces can be machined to bring the inner and outer diameters to the required dimensions for placement on the mandrel portion 34. It can also be tested separately from the mandrel portion 34.

In an embodiment, the second tubular section 16 is supplied with an extended portion 88 from the second end 54. This extended portion 88 provides a base 90 at the weld location 82, supporting the end face 72 of the sleeve body 14. This is as illustrated in FIG. 3(*a*). The annular end face 62 of the second tubular section 16, now appears as a ledge 92. Each of the faces 62,72 is conical so as to provide a circumferential pool 94 into which a metal can be deposited when the weld 82 is formed, see FIG. 3(*b*).

Such metal deposition can occur in gas metal arc welding (GMAW), sometimes referred to by its subtypes metal inert gas (MIG) welding or metal active gas (MAG) welding. It is a welding process in which an electric arc forms between a consumable wire electrode and the workpiece metal(s), which heats the workpiece metal(s), causing them to melt and join. Along with the wire electrode, a shielding gas feeds through the welding gun, which shields the process from contaminants in the air. When used on steel, the preferred material of the sleeve body 14 and second tubular section 16, it provides a fast weld which allows rotation of the workpiece or the welding gun around the workpiece to fill the pool 94 on the part assembly 86. Other types of weld may also be used.

Figure 4:
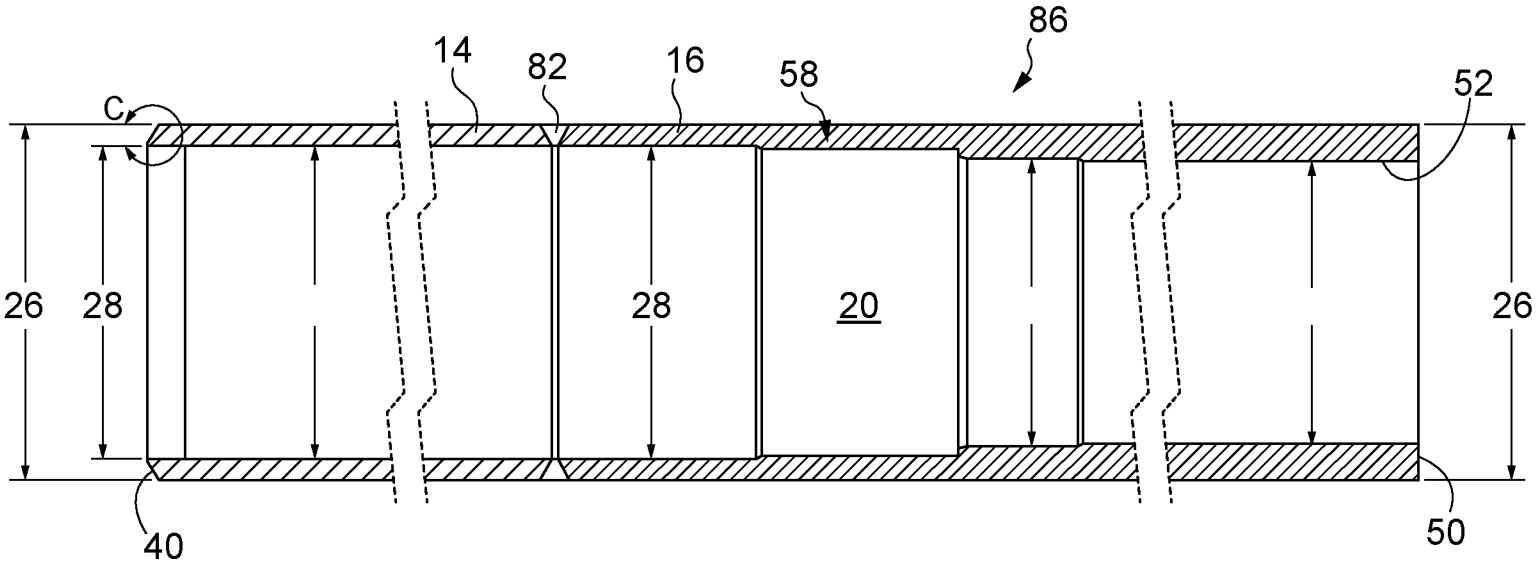
FIG. 4 is a cross-sectional view through the sleeve body and second tubular section of FIG. 3(*a*) forming a part assembly at step (b) according to a further embodiment of the present invention.

Once welded together the part assembly is machine finished as shown in FIG. 4. In this process the outer diameter is brought back to the maximum outer diameter 26 and the inner diameter is machined out to the desired inner diameter 28 of the central bore 20. The part assembly 86 can now be inspected and tested as is known in the art, with both sides of the weld 82 being accessible. The screw-thread 58 and coupling 52 can be machined into the second tubular section 16 at this time or can be machined into a blank cylindrical body prior to the weld 82 being made.

The assembly 10 is then completed as per FIG. 5(*a*). The mandrel portion 34 of the first tubular section 12 is located coaxially within the sleeve body 14 of the part assembly 86. The inner diameter 74 of the sleeve body 14 is just greater than the outer diameter 36 of the supporting mandrel portion 34 so that it only has sufficient clearance to slide over the portion 34 during assembly. Sleeve body 14 is a steel cylinder being formed from typically 316L or Alloy 28 grade steel but could be any other suitable grade of steel or any other metal material or any other suitable material which undergoes elastic and plastic deformation. Ideally the material exhibits high ductility i.e. high strain before failure. The sleeve body 14 is appreciably thin-walled of lower gauge than the ends 22,50 of the tubular sections 12,16 and is preferably formed from a softer and/or more ductile material than that used for the supporting mandrel portion 34 and tubular sections 12,16, these typically being 4130 grade steel. The sleeve body 14 may be provided with a non-uniform outer surface 96 such as ribbed, grooved or other keyed surface in order to increase the effectiveness of the seal created by the sleeve body 14 when secured within another casing section or borehole.

In the embodiment shown, portions 98*a,b* towards the first and second ends 70,72 of the sleeve body 14, have a thicker side wall. This leaves a thinner walled central portion 100. In this arrangement the central portion 100 will morph prior to the end portions 98*a,b*.

When the first tubular section 12 is brought together with the part assembly 86, the second tubular section 16 and the first tubular section 12, at the mandrel portion 34, are coupled together in a fixed arrangement via the screw-threaded coupling 42,58. The length of the sleeve body 14 is selected to ensure that a secure and sealed coupling 42,58 is made while allowing the first annular face 70 of the sleeve body 14 to meet and abut the annular face 40 of the first tubular section 12.

The first annular face 70 of the sleeve body 14 is then welded to the annular face 40 of the first tubular section 12. This is as illustrated in FIG. 5(*b*). The end face 70 is supported at the ledge 32 on the mandrel portion 34. The weld 80 is formed by an electron beam method. Electron-beam welding (EBW) is a fusion welding process in which a beam of high-velocity electrons is applied to the two materials to be joined. The workpieces melt and flow together as the kinetic energy of the electrons is transformed into heat upon impact. There is no additional metal deposited which limits the outflow on the inner surface 66 of the sleeve body 14. Thus the welds 80,82 may be formed using different techniques. A different technique other than EBW could be used to form the weld 80.

The assembly 10 can then have a final machine finish to bring the outer surface 30,96 at the weld location 80 down to the desired outer diameter 26 for the assembly. Following a final inspection, the assembly 10 is now ready for use as a morphable packer or isolation barrier.

The assembly 10 advantageously has a side wall thickness, being the half the outer diameter 26 minus the inner diameter 28 which is substantially uniform along the length of the assembly 10. Additionally, the side wall thickness is less than 10% of the outer diameter 26. This provides a light-weight assembly with a large central bore 20.

Reference will now be made to FIG. 6(*a*) of the drawings which provides an illustration of a method for setting the assembly 10 within a well bore to provide an isolation barrier. Like parts to those in FIGS. 3(*a*), 3(*b*) to 5(*a*), 5(*b*) have been given the same reference numerals to aid clarity. In use, the assembly 10 is conveyed into the borehole by any suitable means, such as incorporating the assembly 10 into a casing or liner string 102 and running the string into the wellbore 104 until it reaches the location within the open borehole 106 at which operation of the assembly 10 is intended. This location is normally within the borehole at a position where the sleeve body 14 is to be expanded in order to, for example, isolate the section of borehole 106*b* located above the sleeve 14 from that below 106*d* in order to provide an isolation barrier between the zones 106*b*, 106*d*. While only a single assembly 10 is shown on the string 102, further assemblies may be run on the same string 102 so that zonal isolation can be performed in a zone 106 in order that an injection, frac'ing or stimulation operation can be performed on the formation 106*a-e* located between two sleeves.

Each sleeve 14 can be set by increasing the pump pressure in the throughbore 20 to a predetermined value which represents a pressure of fluid at the port 44 being sufficient to morph the sleeve 14. This morphed pressure value will be calculated from knowledge of the diameter 26 of assembly 10, the approximate diameter of the borehole 106 at the sleeve 14, the length of the sleeve 14, the material properties of the sleeve and thickness of the sleeve 14. The morphed pressure value is the pressure sufficient to cause the sleeve 14 to move radially away from the mandrel portion 34 by elastic expansion, contact the surface 108 of the borehole and morph to the surface 108 by plastic deformation.

Check valves are arranged to allow fluid from the throughbore 20 to enter the chamber 84. This fluid will increase pressure in the chamber 84 and against the inner surface 66 of the sleeve 14 so as to cause the sleeve 14 to move radially away from the mandrel portion 34 by elastic expansion, contact the surface 104 of the borehole and morph to the surface 104 by plastic deformation. When the morphing has been achieved, the check valves will close and trap fluid at a pressure equal to the morphed pressure value within the chamber 84.

The sleeve 14 will have taken up a fixed shape under plastic deformation with the inner surface 66 matching the profile of the surface 108 of the borehole 106, and the outer surface 96 also matching the profile of the surface 108 to provide a seal which effectively isolates the annulus 112 of the borehole 106 above the sleeve 14 from the annulus 110 below the sleeve 14. If two assemblies are set together then zonal isolation can be achieved for the annulus between the sleeves. At the same time the sleeves have effectively centred, secured and anchored the tubing string 102 to the borehole 106.

An alternative method of achieving morphing of the sleeve 14 of the assembly 10 may use a hydraulic fluid delivery tool. A detailed description of the operation of such a hydraulic fluid delivery tool is described in GB2398312 and with reference to the morphing of a sleeve to achieve a seal across a wellbore in WO2016/063048 and in particular with reference to FIG. 6B, the disclosures of which is incorporated herein by reference. The entire disclosures of GB2398312 and WO2016/063048 are incorporated herein by reference.

Using either pumping method, the increase in pressure of fluid directly against the sleeve 14 causes the sleeve 14 to move radially outwardly and seal against a portion of the inner circumference of the borehole 106. The pressure against the inner surface 66 of the sleeve 14 continues to increase such that the sleeve 14 initially experiences elastic expansion followed by plastic deformation. The sleeve 14 expands radially outwardly beyond its yield point, undergoing plastic deformation until the sleeve 14 morphs against the surface 108 of the borehole 106 as shown in FIG. 6(*b*). If desired, the pressurised fluid within the space can be bled off following plastic deformation of the sleeve 14. Accordingly, the sleeve 14 has been plastically deformed and morphed by fluid pressure without any mechanical expansion means being required. When the morphing has been achieved, the check valves can be made to close and trap fluid at a pressure equal to the morphed pressure value within the chamber 84.

The principle advantage of the present invention is that it provides a method of manufacturing an assembly for creating an isolation barrier in which a mandrel of the assembly is not affected by welding.

A further advantage of the present invention is that it provides a method of manufacturing an assembly for creating an isolation barrier in which different welds can be used and a first weld can be inspected prior to complete assembly.

It will be apparent to those skilled in the art that modifications may be made to the invention herein described without departing from the scope thereof. For example, while a morphed pressure value is described this may be a pressure range rather than a single value to compensate for variations in the pressure applied at the sleeve in extended well bores. The end faces need not be exactly perpendicular to the central longitudinal axis but may be tapered or of any profile which matches or is complimentary to that of the opposing face. It will be appreciated that use of welding includes with or without application of heat and/or pressure and or a filler material, including any fusion, non-fusion or pressure welding technique as is determined to be appropriate.

We claim:

1. A method of manufacturing an assembly for use as an isolation barrier, which when assembled comprises:

a first tubular section, the first tubular section including: at a first end a coupling to connect the first tubular section to a tubular string; a mandrel portion extending to a second end; and an annular face formed on a ledge arranged circumferentially around and extending radially outwards from an outer surface of the first tubular section;

a second tubular section, the second tubular section including: at a first end a coupling to connect the second tubular section to a tubular string; and at a second end, an annular face arranged perpendicularly to a central axis of the second tubular section;

a sleeve body, being a tubular section having first and second end faces, respectively, at each end thereof;

wherein: the sleeve body is arranged over the mandrel portion between the first and second tubular sections; the annular face of the first tubular section is welded to the first end face of the sleeve body; the annular face of the second tubular portion is welded to the second end face of the tubular body; and the mandrel portion is connected to the second tubular portion so as to create a chamber between the sleeve body and the mandrel portion, which can be filled with fluid via a port in the mandrel portion so as to expand the sleeve body;

the method comprising the steps, in order:

(a) welding the annular face of the second tubular section to the second end face of the sleeve body;

(b) machining at least the inside of the sleeve body and the inside of the second tubular portion to provide a central bore of a first diameter, through the sleeve body and the second tubular portion at the weld;

(c) sliding the sleeve body over the mandrel portion;

(d) coupling the mandrel portion to the second tubular section; and (e) welding the annular face of the first tubular section to the first end face of the sleeve body.

2. A method according to claim 1 wherein the annular face arranged perpendicularly to the central axis of the second tubular section is provided on a ledge so that the sleeve body is supported at the second end face for the welding at step (a) to be carried out.

3. A method according to claim 2 wherein at step (b) machining removes a portion of the second tubular section so that only the ledge remains and the welded joint provides connection of two abutting annular faces.

4. A method according to claim 1 wherein the weld at step (a) is formed by a different technique than the weld at step (e).

5. A method according to claim 1 wherein the weld at step (a) is a gas metal arc weld (GMAW).

6. A method according to claim 1 wherein the weld at step (e) is an electron beam weld (EBW).

7. A method according to claim 1 wherein the weld at step (a) is an electron beam weld (EBW).

8. A method according to claim 1 wherein the weld at step (e) is a gas metal arc weld (GMAW).

9. A method according to claim 1 wherein the coupling between the mandrel portion and the second tubular section is by screw-threads.

10. A method according to claim 1 wherein the method includes a further step of machining over the weld of step (e).

11. A method according to claim 1 wherein the method includes the step of selecting a sleeve body having a material which yields more easily under pressure than the material of the first and second tubular sections.

12. A method according to claim 1 wherein the method includes the step of machining the outer surface of the sleeve body over a portion thereof, to reduce a thickness of the sleeve body.

13. A method of manufacturing an assembly for use as an isolation barrier, which when assembled comprises:

a first tubular section, the first tubular section including: at a first end a coupling to connect the first tubular section to a tubular string; a mandrel portion extending to a second end; and an annular face formed on a ledge arranged circumferentially around and extending radially outwards from an outer surface of the first tubular section;

a second tubular section, the second tubular section including: at a first end a coupling to connect the second tubular section to a tubular string; and at a second end, an annular face arranged perpendicularly to a central axis of the second tubular section;

a sleeve body, being a tubular section having first and second end faces, respectively, at each end thereof;

wherein: the sleeve body is arranged over the mandrel portion between the first and second tubular sections; the annular face of the first tubular section is welded to the first end face of the sleeve body; the annular face of the second tubular portion is welded to the second end face of the tubular body; and the mandrel portion is connected to the second tubular portion so as to create a chamber between the sleeve body and the mandrel portion, which can be filled with fluid via a port in the mandrel portion so as to expand the sleeve body;

the method comprising the steps, in order:

(a) welding the annular face of the second tubular section to the second end face of the sleeve body, wherein the annular face arranged perpendicularly to the central axis of the second tubular section is provided on a ledge so that the sleeve body is supported at the second end face for the welding to be carried out;

(b) machining the sleeve body and the second tubular portion to provide a central bore of a first diameter over the weld and the machining removes a portion of the second tubular section so that only the ledge remains and the welded joint provides connection of two abutting annular faces;

(c) sliding the sleeve body over the mandrel portion;

(d) coupling the mandrel portion to the second tubular section; and (e) welding the annular face of the first tubular section to the first end face of the sleeve body.

* * * * *